United States Patent [19]

Jeschke

[11] Patent Number: 4,785,736

[45] Date of Patent: Nov. 22, 1988

[54] DEVICE FOR TENSIONING A FLEXIBLE PRINTING PLATE MOUNTED ON A PLATE CYLINDER

[75] Inventor: Willi Jeschke, Heidelberg, Fed. Rep. of Germany

[73] Assignee: Heidelberger Druckmaschinen AG, Heidelberg, Fed. Rep. of Germany

[21] Appl. No.: 13,010

[22] Filed: Feb. 10, 1987

[30] Foreign Application Priority Data

Feb. 11, 1986 [DE] Fed. Rep. of Germany ..... 3604209

[51] Int. Cl.[4] ..... B41L 29/06

[52] U.S. Cl. ..... 101/415.1; 101/DIG. 12

[58] Field of Search ..... 101/415.1, DIG. 12

[56] References Cited

U.S. PATENT DOCUMENTS

| | | | |
|---|---|---|---|
| 1,313,082 | 8/1919 | Fraser | 101/DIG. 12 |
| 2,737,887 | 3/1956 | Gericke | 101/415.1 |
| 2,973,710 | 3/1961 | Hantscho | 101/415.1 |
| 2,984,179 | 5/1961 | Ford | 101/415.1 |
| 4,056,829 | 11/1977 | Ikeda | 101/415.1 |
| 4,459,913 | 7/1984 | Kowalik | 101/415.1 |

FOREIGN PATENT DOCUMENTS

| | | | |
|---|---|---|---|
| 154843 | 9/1985 | European Pat. Off. | 101/415.1 |
| 1173916 | 7/1964 | Fed. Rep. of Germany | 101/415.1 |
| 2001849 | 7/1971 | Fed. Rep. of Germany | 101/415.1 |
| 2233836 | 2/1973 | Fed. Rep. of Germany | 101/415.1 |
| 1082639 | 9/1967 | United Kingdom | 101/415.1 |
| 1183583 | 3/1970 | United Kingdom | 101/415.1 |

*Primary Examiner*—Clyde I. Coughenour

*Attorney, Agent, or Firm*—Herbert L. Lerner; Laurence A. Greenberg

[57] ABSTRACT

A device for tensioning a flexible printing plate mounted on a plate cylinder of a rotary printing machine having a device for pivoting the printing plate on the plate cylinder so as to provide a register correction, the printing plate having ends which are clamped in tensioning rails, include respective pivot levers via which the tensioning rails are articulatingly connected at both ends thereof, respectively, the pivot levers being pivotally mounted on a cylinder body, and a cam device for tipping and displacing the tensioning rails relatively to one another so that the printing plate is pivotable about a precisely defined pivot point.

13 Claims, 5 Drawing Sheets

DEVICE FOR TENSIONING A FLEXIBLE PRINTING PLATE MOUNTED ON A PLATE CYLINDER

The invention relates to a device for mounting and tensioning flexible printing plates on the plate cylinder of a rotary printing machine having a device for pivoting the printing plate on the plate cylinder so as to provide a register connection, the printing plate having ends which are clamped in tensioning rails.

With modern rotary offset printing machines it is necessary to provide not only a lateral or side and circumferential register adjustment, but also to provide a possibility of turning or twisting the printing image of a given printing unit over a given extent in order to produce high-quality printed products. Owing to this possibility, photocopying and mounting or tensioning errors as well as other faults, which would lead to register differences in at least some parts of the finished product, can be counteracted.

German Pat. (DE-PS) No. 15 36 954 shows a device for pivoting and turning, respectively, a flexible printing plate on a plate cylinder in which the printing plate is held circumferentially at both ends thereof by means of tensioning rails. Via an adjusting device, both plate ends together with the tensioning rails can be moved in opposite directions, so that the printing plate on the plate cylinder is turned or twisted. The tensioning rails are guided in obliquely arranged or inclined slits in which guide bolts engage. As a result of this, the tensioning rails, when moving axially, perform a given pivoting movement which is meant to correspond to the turning or torsional movement of the two plate ends. A disadvantage of this conventional construction is that the device can only be actuated when the machine is at a standstill. Moreover, it is necessary initially to release the tension of the plate via two eccentrics in order to adjust the plate. Then the plate can be turned or torsionally adjusted on the plate cylinder via a worm and an adjusting member, in which case the oblique or inclined slits do not permit accuracy and may also lead to jamming of the tensioning rails. After the turning or torsional movement of the printing plate, the tensioning device must be actuated in order to reclamp the printing plate on the plate cylinder. Only then may the printing machine be restarted, so that it is obvious that, with this conventional construction, the adjustment is complicated and time-consuming and thus does not permit an exact register adjustment which meets today's requirements, as do so-called register systems.

Heretofore also known German Pat. (DE-PS) No. 893 343 also shows a device for mounting and tensioning printing plates in which the individual tensioning rails can be displaced separately and independently of one another in axial direction by means of eccentrics and a number of intermediate members having detrimental play. In doing so, a middle pivotal point enables pivoting of the tensioning rails in accordance with the axial displacement of the end of the printing plate. With this type of plate tensioning, also the tensioning screws have to be loosened initially in order to be able to displace the printing plate. In addition to the aforementioned disadvantages, this construction has the further disadvantage that it is only suited for relatively small sheet sizes or formats e.g. for small-size offset printing machines using edge-punched metal foils.

Based upon this prior art, it is an object of the invention to provide a register adjusting device which can be set in a simple manner as well as with great precision even when the printing machine is running. Moreover, it is possible therewith to tension the plate very quickly.

With the foregoing and other objects in view, there is provided, in accordance with the invention, a device for tensioning a flexible printing plate mounted on a plate cylinder of a rotary printing machine having a device for pivoting the printing plate on the plate cylinder so as to provide a register correction, the printing plate having ends which are clamped in tensioning rails, comprising respective pivot levers via which the tensioning rails are articulatingly connected at both ends thereof, respectively, the pivot levers being pivotally mounted on a cylinder body, and cam means for tipping and displacing the tensioning rails relatively to one another so that the printing plate is pivotable about a precisely defined pivot point. This construction ensures a stable and exact adjustment of both tensioning rails, the pressman being able to perform this adjustment while the machine is running. Due to the exact and play-free guidance of both tensioning rails and the relatively simple adjusting mechanism, it is possible to adjust the individual positions by means of different control means in accordance with further feaures of the invention.

In accordance with another feature of the invention, the cam means comprise a cam carried by a side frame of the printing machine, and adjusting means are fastened to at least one of the tensioning rails and are cooperatively engaged by the cam for torsionally stressing the printing plate.

In accordance with an added feature of the invention, the cam means comprise a cam carried by a side frame of the printing machine, and a cam roller is arranged at one of the tensioning rails, and adjusting means are provided for pivoting the cam into a working position thereof wherein it is in cooperative engagement with the cam roller, the pivoting of the cam by the adjusting means being effective while the printing machine is running.

In accordance with an additional feature of the invention, the cam roller is mounted via a roller lever on one of the tensioning rails, the roller lever together with the tensioning rails being pivotable by the cam in an initial phase of the working position thereof so that the printing plate is untensioned on the cylinder body against an opposing compression-spring basis, in a subsequent phase of the working position, the cam roller imparting an axial movement to the one tensioning rail, and in a running-down or decelerating phase of the working position, the one tensioning rail being pivoted back to its position wherein the printing plate is subjected to tension by the compression-spring bias.

In accordance with a further feature of the invention, the cam is movable into the working position thereof for pivoting the roller lever together with the tensioning rails so as to untension the printing plate on the cylinder body in an initial working phase, side register adjusting means being then actuable for axially adjusting the cylinder body, the cam being thereafter movable back from the working position thereof to an original position thereof in which the printing plate is under tension, the side register adjusting means being then actuable for readjusting the plate cylinder to an original position thereof.

In accordance with again another feature of the invention, the cam means comprise a cam roller arranged at each end of one of the tensioning rails and cooperatively engaging a respective cam, the cam rollers and the cams having respective sloping or inclined rolling surfaces.

In accordance with again an added feature of the invention, the cam and the cam roller have cooperatively engaging rolling surfaces beveled or inclined on both sides thereof, and means are provided for laterally adjusting the cam on the machine side frame, the lateral adjusting means comprising an adjusting motor fastened to the machine side frame.

In accordance with again an additional feature of the invention, there are included Schmitz rings mounted at opposite ends of the plate cylinder, a respective roller lever located at each end of the one tensioning rail, a respective cam roller being carried by each of the roller levers, each of the cam rollers cooperatively engaging a respective cam formed as a race, the cam rollers and the cams, respectively, having rolling surfaces beveled or inclined at one side thereof, the cams being axially displaceable for releasing tension in the printing plate and for varying torsion register thereof, both the cam rollers and the cams being located beyond the Schmitz rings and away from the plate cylinder.

In accordance with again a further feature of the invention, the printing plate is formed with an angle portion at the ends thereof and suspended by the end angle portions from the tension rails, and compression springs are located between the tensioning rails and the cylinder body for applying tension to the printing plate, and spring elements are provided for retaining the end angle portions on the tensioning rails.

In accordance with yet another feature of the invention, there are provided coupling elements mutually connecting both pivotally mounted tensioning rails so that they are pivotable in common, the tipping of the tensioning rails being transmissible via the roller levers and being simultaneously effected in opposite rotary directions by the tensioning rails.

In accordance with yet an added feature of the invention, the pivot levers for adjusting the tensioning rails are constructed as angular levers and are pivotally mounted on bearing bolts at the bottom of a cylinder channel formed in the cylinder body so that a pivot point about which the printing plate is pivotable when torsion register of the plate is adjusted is located in a printing image region of the printing plate.

In accordance with yet an additional feature of the invention, the angular levers, respectively, have two legs each differing in length, each of the angular levers having a pivot point offset towards the shorter of the two legs thereof and, in a midposition of the angular levers, and means located thereon for mutually connecting the tensioning rails and the angular levers are disposed on imaginary lines extending perpendicularly to a longitudinal axis of the plate cylinder.

In accordance with a concomitant feature of the invention, there are provided bolts and universal joint bearings mutually connecting the tensioning rails and the angular levers.

Other features which are considered as characteristic for the invention are set forth in the appended claims.

Although the invention is illustrated and described herein as embodied in a device for tensioning a flexible printing plate mounted on a plate cylinder of a rotary printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
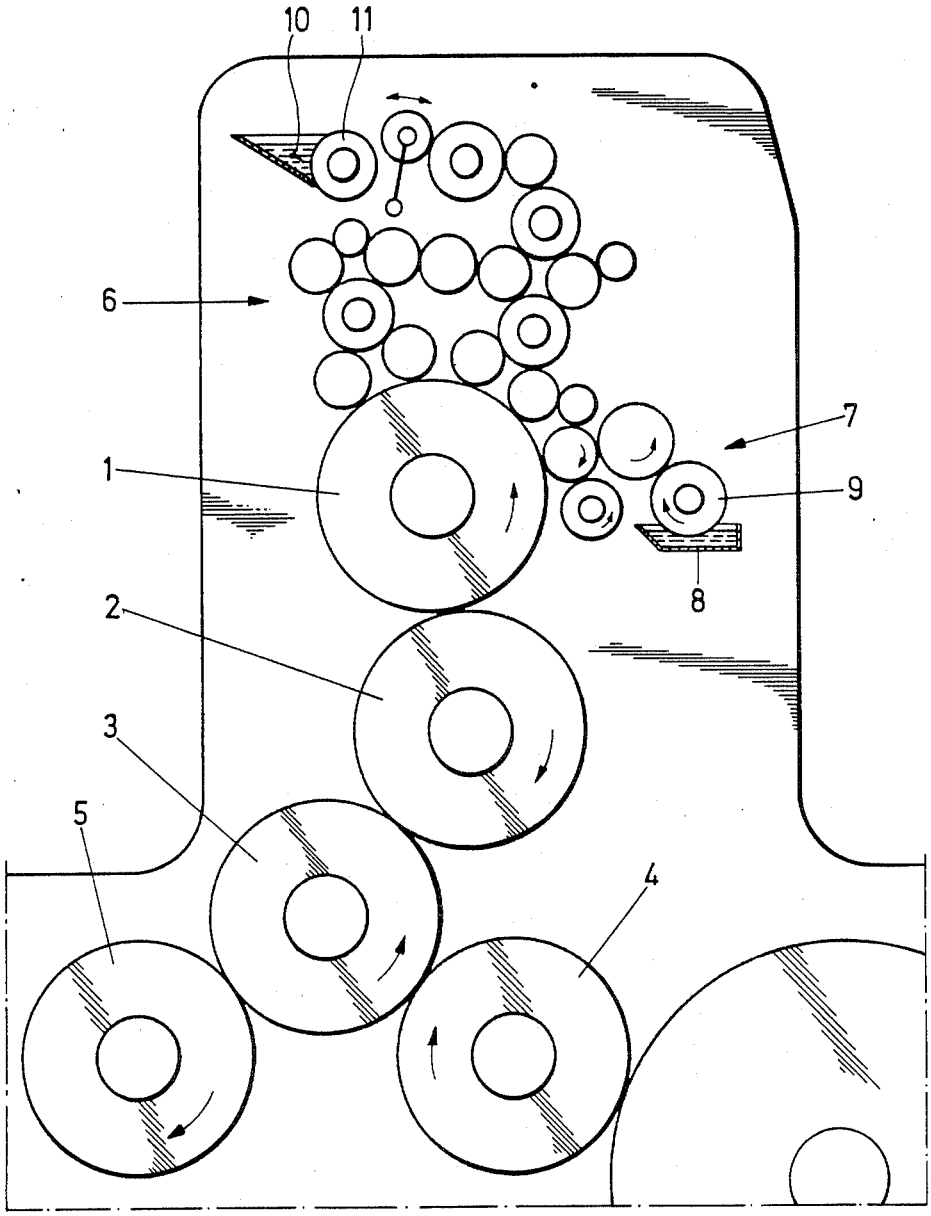
FIG. 1 is a diagrammatic side elevational view of a printing unit.

Referring now to the drawing and first, particularly, to FIG. 1 thereof, there is shown a printing unit of a sheet-fed rotary printing machine formed essentially of a plate cylinder 1, a blanket cylinder 2 and an impression cylinder 3, the sheets to be printed being, in fact, printed between the blanket cylinder 2 and the impression cylinder 3. A transfer drum 4 transfers or surrenders the fed sheets to the impression cylinder 3, and a succeeding drum 5 takes the sheets from the impression cylinder 3 and supplies them to the following printing unit, transport of the sheet, as such, being effected in a conventional manner by means of gripper rows. Assigned to the plate cylinder 1 is an inking unit 6 and a dampening unit 7, a dampening roller 9 supplying the dampening unit 7 with dampening medium from a dampening-medium container 8, an ink duct roller 11 feeding ink to the inking unit 6 from an ink duct 10.

Figure 2:
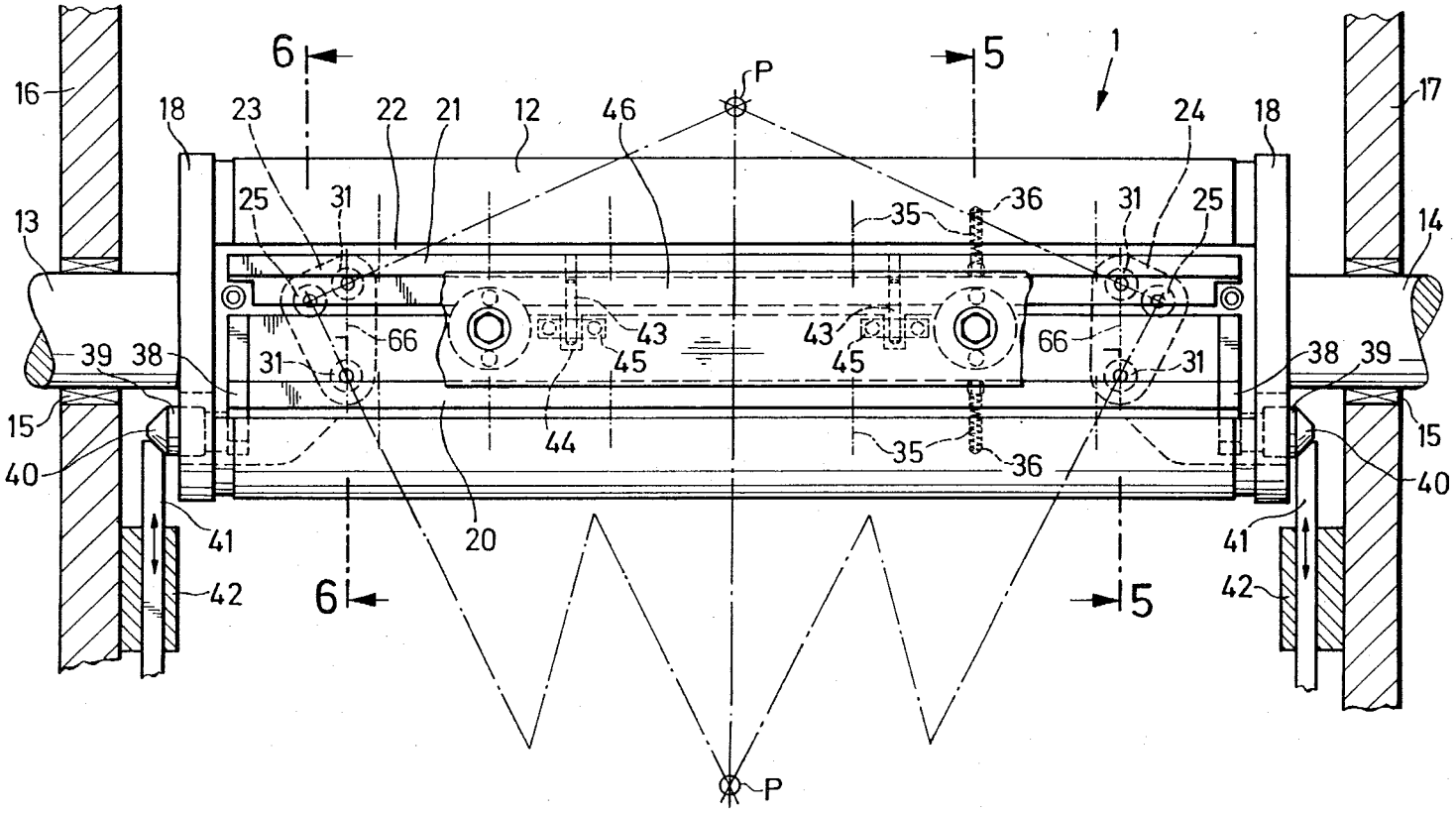
FIG. 2 is an enlarged top plan view of a plate cylinder shown in FIG. 1.
Figure 5:
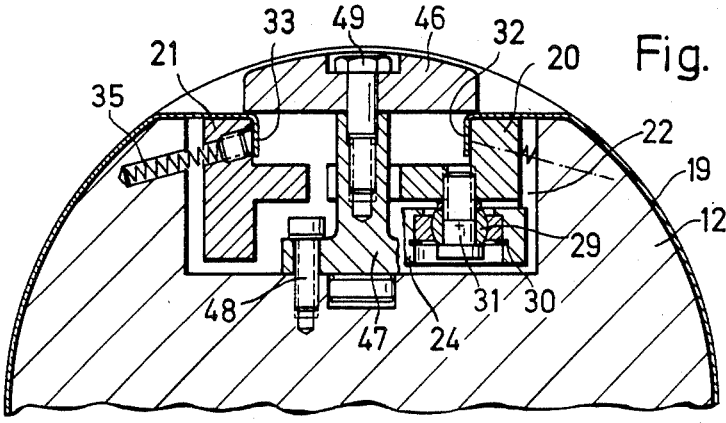
FIG. 5 is a fragmentary cross-sectional view of the plate cylinder of FIG. 2 taken along the line 5—5.
Figure 6:
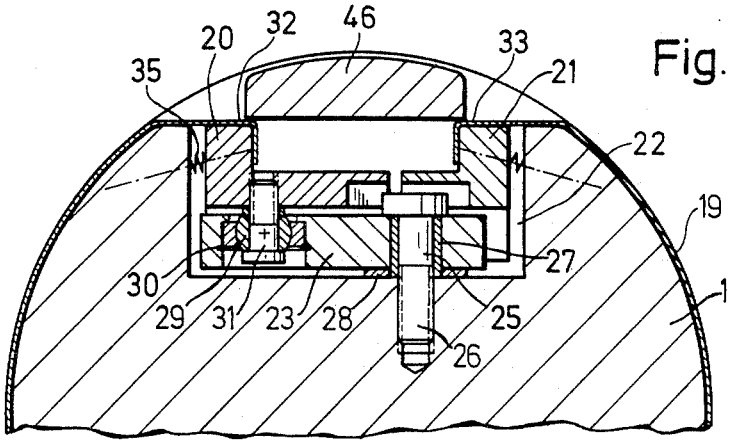
FIG. 6 is a fragmentary cross-sectional view of the plate cylinder of FIG. 2 taken along the line 6—6.

The plate cylinder 1 shown in FIG. 2 is formed of a cylinder body 12 having shaft journals 13 and 14 on both sides thereof which are mounted in machine side frames 16 and 17 via bearings 15. In the illustrated embodiment of FIG. 2 there are provided cylinder bearers or so-called Schmitz rings 18 at both sides of the cylinder body 12. On the cylinder body 12, there is mounted a flexible printing plate 19 (FIG. 4) which is clamped thereon by tensioning or clamping rails 20 and 21. Both tensioning or clamping rails 20 and 21 are arranged in a channel 22 formed in the cylinder body 12 (FIGS. 4–6).

For correcting the register, both ends of each of the two tensioning rails 20 and 21 are articulatingly connected to one another by a respective angular lever 23, 24. Each of the angular levers 23 and 24 is pivotally mounted on a bearing bolt 25 (FIG. 6) in the channel 22 of the cylinder body 12, the bearing bolt 25 being fastened in the bottom of the channel 22 by means of a thread 26. Between the bearing bolt 25 and the respective angular lever 23, 24, there is provided a fitting or register bushing 27 which, in combination with a washer 28, ensures exact guidance of the respective angular lever 23, 24.

The respective angular lever 23, 24 is connected with the respective tensioning rail 20, 21 via a play-free ball-joint bearing 29 which is held in the respective angular lever 23, 24 by means of a spring washer 30. The ball-joint bearings 29 are connected with the respective tensioning rails 20 and 21 by means of screw bolts 31, so as to ensure thereby an exact and play-free guidance of both tensioning rails 20 and 21 (FIGS. 2, 5 and 6).

Figure 4:
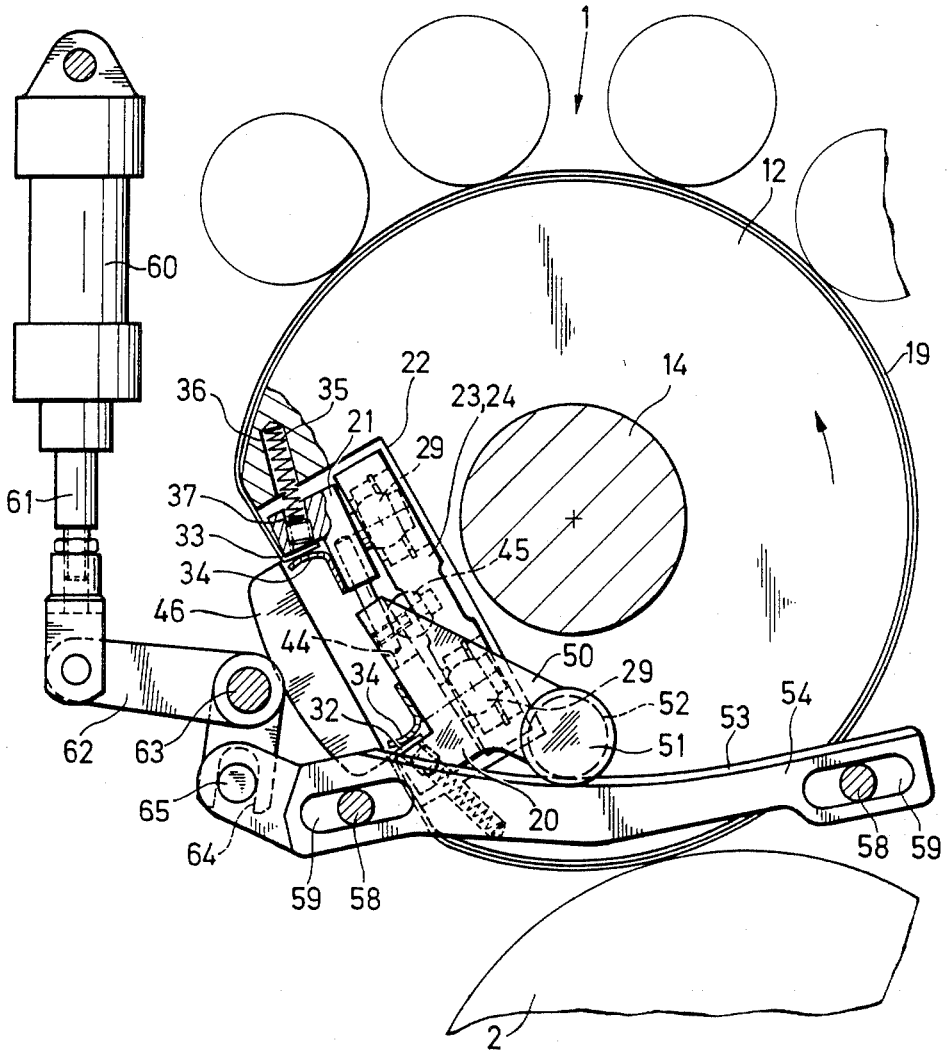
FIG. 4 is an enlarged end view of the plate cylinder of FIG. 3.

The flexible printing plate 19 to be mounted and clamped on the cylinder casing is formed with an angle at both ends 32 and 33 thereof, the angle parts being hooked on or suspended from the clamping rails 20 and 21 (FIG. 4). In this regard, both angle-shaped plate ends 32 and 33 are held by spring elements 34 in order to prevent the angle-shaped plate ends from slipping out inadvertently. Between the clamping rails 20, 21, and the cylinder body 12, there are provided several compression springs 35 for tensioning the printing plate 19, the compression springs 35 being arranged in recesses 36 formed in the cylinder body 12 and in bores 37 formed in the tensioning rails 20 and 21.

For pivoting the printing plate 19 on the cylinder body 12, according to FIG. 2, a respective roller lever 38 is fastened to each end of the clamping rail 20, each roll lever 38 carrying a cam roller 39 which, in turn, in its outer region, is provided with a chamfer 40 in the form of a truncated cone. In the illustrated embodiment, each chamfer 40 of the two cam rollers 39 interacts with a respective cam 41, the cams 41 being mounted at the machine side frames 16 and 17 via bearings 42.

According to the embodiment shown in FIG. 2, both cams 41 are pivoted about or adjusted by the same stroke towards the cam rollers 39 for clamping the printing plate 19, so that equal pressure is exerted on the cam rollers and the clamping rail 20 is pivoted in the ball-joint bearings 29 about its longitudinal axis via both roller levers 38. For the common pivoting of both clamping rails 20 and 21, coupling elements 43 are provided, each of which is mounted on one side in the clamping rail 21. In the opposite clamping rail 20, recesses 44 are provided in which the coupling elements 43 are supported by bearings 45 which are fastened to the clamping rail 20. These coupling elements 43 transmit the tilting movement of the clamping rail 20 to the clamping rail 21, so that simultaneously both clamping rails perform a tilting movement in opposite rotary directions. FIG. 4 shows both clamping or pretensioning rails 20 and 21 in tilted position. This tilted position is simultaneously the untensioned position of the printing plate 19, so that the angle-shaped plate ends 32 and 33 can be hooked on or suspended from the tensioning or clamping rails 20 and 21 without any difficulty. The instant the cams 41 are moved back, both tensioning or clamping rails 20 and 21 are pivoted back via the compression springs 35, so that the printing plate on the cylinder body 12 is subjected to tension. A cover plate 46 is arranged above the tensioning or clamping rails 20 and 21 in such a way that, when the tensioning or clamping rails are pivoted back to the tensioned position of the printing plate 19, both angle-shaped plate ends 32 and 33 are located under the plate 46, thus producing a gap which corresponds to the thickness of the printing plate, so that both plate ends are secured against sliding out of the tensioning or clamping rails 20 and 21.

The cover plate 46 is attached to centering bodies 47 which, in turn, are fastened via screws 48 to the bottom of the channel 22. The cover plate 46 is precisely positioned by fitting screws 49, so that both ends 32 and 33 of the printing plate can be hooked onto or suspended from the tensioning or clamping rails 20 and 21 without any difficulty. FIG. 5 shows both tensioning or clamping rails 20 and 21 in tensioned position thereof, both plate ends 32 and 33 being pivoted under the cover plate 46.

Figure 3:
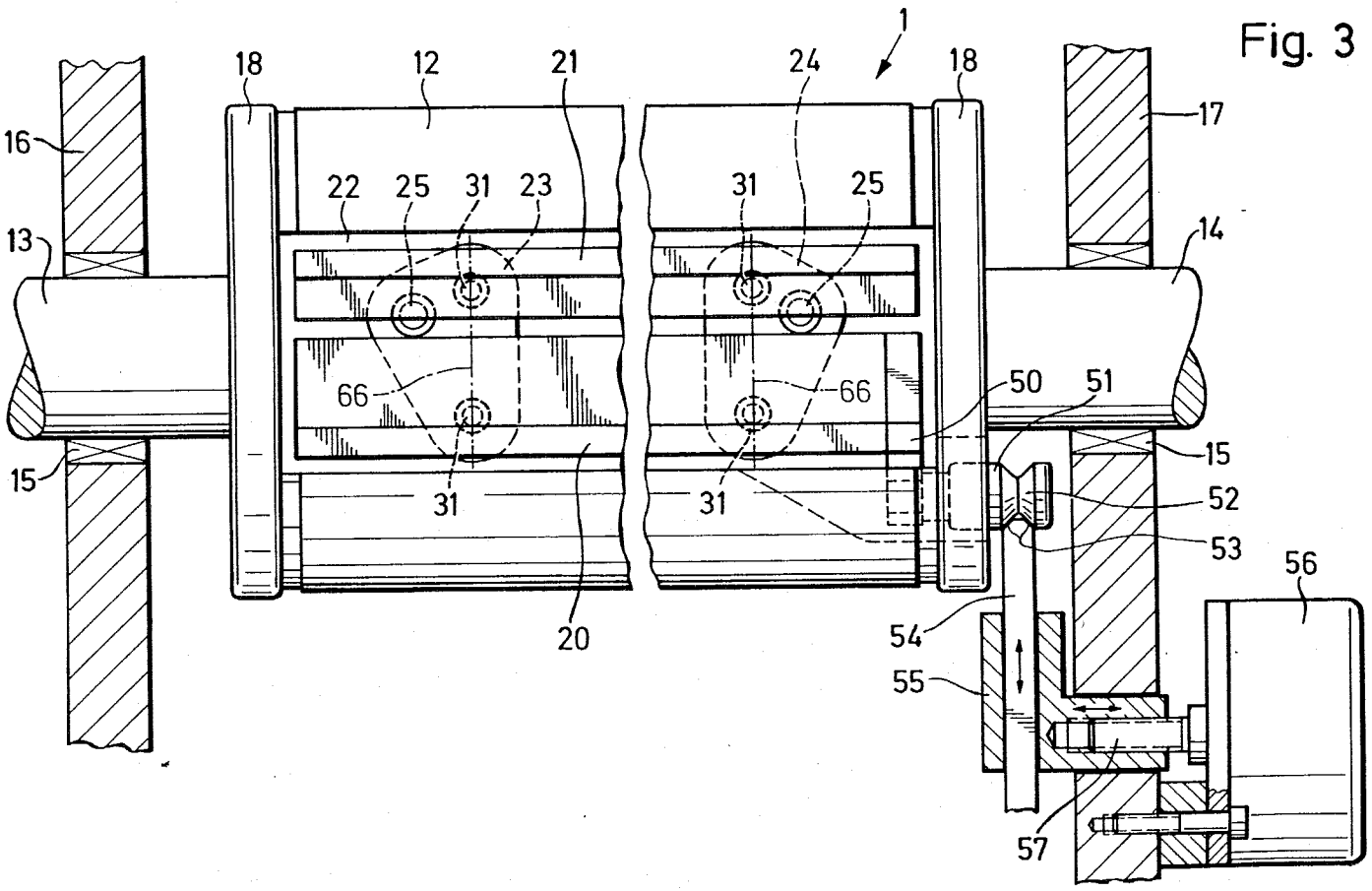
FIG. 3 is a top plan view of a plate cylinder having a different control system from that shown in FIG. 2.

As a modification of the embodiment in FIG. 2, at one end of the tensioning or clamping rail 20 of FIG. 3, a roller lever 50 is shown which also bears a cam roller 51, the roller surface of which is constructed as a V-shaped groove 52 into which a V-shaped rolling surface 53 of a cam 54 engages. The cam 54 can be moved towards the cam roller 51 for loosening a printing plate and away from the cam roller 51 for tensioning a printing plate so that, via the roller lever 50, a tilting or tipping movement is transmitted to both tensioning or clamping rails 20 and 21.

For register correction, the aforedescribed device permits pivoting of the printing plate 19 on the plate cylinder 1. For this purpose, the tensioning or clamping rail 20 is displaced in axial direction of the plate cylinder 1 via cam rollers 39, 51 and roller levers 38, 50. Via the angular levers 23 and 24, this lateral adjustment of the tensioning or clamping rail 20 is transmitted to the tensioning or clamping rail 21 in opposite direction. In this regard, the angular levers 23 and 24 can be constructed with equal-sided legs, forming a right angle so that, for the respective spacing between the two bearing bolts 25, a given pivot point P for the turning movement of the printing plate 19 results. In mid-position, the centers of the screw bolts 31 are located on lines 66 extending perpendicularly to the longitudinal axis of the plate cylinder.

Due to suitably selected leg lengths of the angular levers 23 and 24 and due to a laterally offset arrangement of the bearing bolts 25 for the rotary movement of the angular levers, the pivot point P about which the printing plate is moved when the turning register is adjusted is at a given location of the printing plate 19. The extensions or elongations of the legs of the angular levers 23 and 24 to the point P represented by dot-dash lines in FIG. 2 are understood as being a development on the surface of the cylinder casing, the upper and the lower pivot points P shown in FIG. 2 being at the same location of the printing plate 19 i.e. the two pivot points P coincide. Described in gear-technology terms, P is the instantaneous pivot point of the printing plate and the tensioning or clamping rails, respectively, which are drivers or links of a multi-member transmission.

For varying the lateral position of both tensioning or clamping rails 20 and 21, according to FIG. 2, one of the cams 41 is moved towards one machine side, and the other cam 41 is moved in opposite direction towards the other machine side. In so doing, an adjusting force is exerted in axial direction of the plate cylinder via the cam rollers 39. Instead of the illustrated radially adjustable cams 41, it is also possible to use cams having the shape of a race and being displaceable in axial direction of the plate cylinder via a suitable bearing. With this arrangement, too, for slanting or inclining the printing plate, it is possible to displace both races axially in the same direction simultaneously, thus effecting an adjustment of both tensioning or clamping rails 20 and 21. In order to release the plate tension with such a construction, it is only necessary to move both races towards one another and towards the center of the machine, so that via the chamfer 40 both roll levers and thus both tensioning or clamping rails 20 and 21 are pivoted.

Contrary to the aforementioned embodiment, the embodiment illustrated in FIG. 3 uses a cam 54, the rolling surface of which is inclined at both sides, the V-shaped groove 52 of the cam roller 51 rolling on that surface. In the illustrated embodiment of FIG. 3, the bearing 55 is constructed in such a way that the cam 54 can either be adjusted radially or pivoted towards the plate cylinder 1. In addition to the lateral adjustment of the two tensioning or clamping rails 20 and 21, an adjustment in axial direction of the plate cylinder 1 is possible via an adjusting motor 56 which is fastened to the machine side frame 17. In the illustrated embodiment of FIG. 3, this is effected by a threaded guide 57. With this embodiment, it thus is possible to respectively tension and untension the printing plate through the radial movement of a cam 54 and laterally to displace both tensioning or clamping rails 20 and 21 through the lateral movement, e.g. by means of an adjusting motor 56, so that the printing plate 19 is turned on the plate cylinder 1 in the aforementioned manner. Of course, measures have been taken to ensure that the bearing is play-free.

FIG. 4 shows the position of the plate cylinder in which the leading end 33 of the printing plate 19 is hooked onto or suspended from the tensioning or clampng rail 21 and in which, after one revolution of the plate cylinder 1, the trailing plate end 32 is also hooked on or suspended and the printing plate is tensioned. For tensioning the printing plate, the cam 54 is displaced on the supporting bolts 58 in the slots 59 in longitudinal direction, so that the rolling cam surface 53, inclined at both sides thereof, pivots the roller lever 50 to a greater or lesser degree, thus loosening the printing plate 19 and tensioning it, respectively. For displacing the cam 54, an hydraulic or pneumatic control cylinder 60 is provided having a piston rod 61 which actuates an angular lever 62 which is pivotally mounted at the machine side frame by means of a bolt 63. The opposite leg of the angular lever 62 has a fork-like opening 64 by means of which a pin 65 attached to the cam 54 is actuated. Thus, the cam 54 can be moved into the respective required position in a relatively simple manner via the control cylinder 60.

The turning of the printing plate 19 for register correcting is normally effected when the printing plate 19 is untensioned. According to the embodiment of FIG. 2, the printing plate is untensioned by pivoting the roller levers 38 to some degree via both cams 41, so that both tensioning or clamping rails 20 and 21 perform a slight tilting movement. For respectively turning and pivoting the printing plate on the cylinder body 12, the left hand or right hand cam, depending upon the turning direction, is moved, for example, towards the center of the cylinder, the opposite cam 41 being moved back in a synchronized manner. In so doing, the tensioning or clamping rail 20 is moved to the left hand and to the right hand sides, respectively, also via the roller levers 38, and the opposite tensioning or clamping rail 21 is moved in opposite direction via the angular levers 23 and 24. After having pivoted the printing plate, both cams 41 are moved back to their original position so that, under the pressure of the compression springs 35, the printing plate is tensioned tightly on the cylinder body 12 via both tensioning or clamping rails 20 and 21.

The functioning of the device according to FIG. 3 differs from the one described hereinabove in that only one cam 54 is provided having a rolling surface which is inclined on both sides thereof so that, via the cam roller 51, it is possible to pivot the roller lever 50 and to displace it in axial direction of the plate cylinder 1. With this construction, pressure is exerted on the cam roller 51 initially via the cam 54 for untensioning the printing plate, so that the tensioning or clamping rail 20 together with the tensioning or clamping rail 21, is slightly tilted via the roller lever 50. The instant the printing plate has thereby been untensioned, the cam 54 can be displaced e.g. via the adjusting motor 56, in axial direction of the plate cylinder, whereby the printing plate is pivoted on the cylinder body 12 via both tensioning or clamping rails 20 and 21 in the aforedescribed manner. This can be effected in one direction or the other depending upon the deviation of the register of the printing plate in oblique or inclined direction with respect to the plate cylinder. In this case, too, the cam roller 51 is relieved of the pressure after being pivoted; so that tensioning of the printing plate 19 is effected via the compression springs 35.

The manner of operation of the embodiment illustrated in FIG. 4 is such that, for loosening the printing plate 19, the control cylinder 60 is used which, to some degree, displaces the cam 54 to the right hand side, e.g. when the plate cylinder 1 is at a standstill, thereby causing a tilting of both tensioning or clamping rails 20 and 21 via the cam roller 51 and the roller lever 50. Thereafter, a non-illustrated lateral register adjusting system at the plate cylinder is actuated in order to pivot the printing plate 19 on the cylinder body 12, so that the cylinder body 12 is displaced to the left hand or to the right hand side to a given extent. This extent thus determnes the turning of the printing plate 19 on the cylinder body 12. Then, the cam 54 is moved back to the position in which the printing plate 19 is tensioned, so that the printing plate is retensioned on the plate cylinder. Thereafter, only the lateral or side register remains to be returned to its original position.

If the printing plate is to be pivoted on the plate cylinder 1 while the machine is running, first the cylinders and the applicator rollers are stopped. Thereafter, the lateral register is adjusted to the required extent and the cam 54 is moved to the right hand side. When the cam roller 51 reaches the rolling cam surface 53 during the following rotary movement, the printing plate 19 is initially untensioned due to the rolling of the cam roller 51 on the surface and, simultaneously, is pivoted due to the lateral displacement of the groove 52 with respect to the cam surface 53. When the cam roller 51 leaves the cam surface 53, the printing plate is automatically tensioned via the compression springs 35. After the inclined setting or position, the lateral register of the plate cylinder is restored to its original position.

The foregoing is a description corresponding in substance to German Application No. P 36 04 209.9, dated February 11, 1986, the International priority of which is being claimed for the instant application, and which is hereby made part of this application. Any material discrepancies between the foregoing specification and the aforementioned corresponding German application are to be resolved in favor of the latter.

I claim:

1. Device for tensioning a flexible printing plate mounted on a plate cylinder of a rotary printing machine having a device for pivoting the printing plate on the plate cylinder so as to provide a register correction, the printing plate having ends which are clamped in tensioning rails, comprising respective pivot levers mounted by a respective pivot on a cylinder body at or near either end of the plate cylinder and connecting the tension rails by respective connections to one another at or near both ends of the tension rails, said connections being ofset from the pivot so that movement about the pivot causes one end of the printing plate to move in one direction and the other end thereof in the opposite direction, and cam means for tipping and displacing the tensioning rails in common relatively to one another so that the printing plate is pivotable about a precisely defined pivot point.

2. Device according to claim 1, wherein said cam means comprise a cam carried by a side frame of the printing machine, and including adjusting means fastened to at least one of the tensioning rails and cooperatively engaged by said cam for torsionally stressing the printing plate.

3. Device according to claim 2, wherein said cam is movable into said working position thereof for pivoting said roller lever together with the tensioning rails so as to untension the printing plate on the cylinder body, side register adjusting means being then actuable for adjusting the cylinder body in axial direction, said cam being thereafter movable back from said working position thereof to an original position thereof in which the printing plate is under tension, said side register adjusting means being then actuable for readjusting the plate cylinder to an original position thereof.

4. Device according to claim 3 including cylinder bearers mounted at opposite ends of the plate cylinder, a respective roller lever located at each end of the one tensioning rail, a respective cam roller being carried by each of the roller levers, each of the cam rollers cooperatively engaging a respective cam formed as a race, said cam rollers and said cams, respectively, having rolling surfaces beveled or inclined at one side thereof, said cams being axially displaceable for releasing tension in the printing plate and for varying torsion register thereof, both said cam rollers and said cams being located beyond said Schmitz rings and away from the plate cylinder.

5. Device according to claim 1, wherein said cam means comprise a cam carried by a side frame of the printing machine, and including a cam roller arranged at one of the tensioning rails, and adjusting means for pivoting said cam into a working position thereof wherein it is in cooperative engagement with said cam roller, said pivoting of said cam by said adjusting means being effective while the printing machine is running.

6. Device according to claim 5, wherein said cam roller is mounted via a roller lever on one of the tensioning rails, said roller lever together with the tensioning rails being pivotable by said cam so that the printing plate is untensioned on the cylinder body against an opposing compression-spring bias, said cam roller imparting an axial movement to the one tensioning rail, and in a running-down or decelerating phase of said working position, the one tensioning rail being pivoted back to its position wherein the printing plate is subjected to tension by said compression-spring bias.

7. Device according to claim 5, wherein said cam and said cam roller have cooperatively engaging rolling surfaces beveled or inclined on both sides thereof, and including means for laterally adjusting said cam on the machine side frame, said lateral adjusting means comprising an adjusting motor fastened to said machine side frame.

8. Device according to claim 1, wherein said cam means comprise a cam roller arranged at each end of one of the tensioning rails and cooperatively engaging a respective cam, the cam rollers and the cams having respective sloping or inclined rolling surfaces.

9. Device according to claim 1, wherein the printing plate is formed with an angle portion at the ends thereof and suspended by said end angle portions from the tension rails, and including compression springs located between the tensioning rails and the cylinder body for applying tension to the printing plate, and spring elements for retaining said end angle portions on said tensioning rails.

10. Device according to claim 1, including coupling elements mutually connecting both pivotally mounted tensioning rails so that they are pivotable in common, the tipping of the tensioning rails being transmissible via roller levers and being simultaneously effected in opposite rotary directions by the tensioning rails.

11. Device according to claim 1, wherein said pivot levers for adjusting the tensioning rails are constructed as angular levers and are pivotally mounted on bearing bolts at the bottom of a cylinder channel formed in the cylinder body so that a pivot point about which the printing plate is pivotable when torsion register of the plate is adjusted is located in a printing image region of the printing plate.

12. Device according to claim 11, including bolts and universal joint bearings mutually connecting the tensioning rails and said angular levers.

13. A device for tensioning a flexible printing plate mounted on a plate cylinder of a rotary printing machine having a device for pivoting the printing plate on the plate cylinder so as to provide a register correction, the printing plate having ends which are clamped in tensioning rails, comprising respective pivot levers via which the tensioning rails are articulatingly connected to one another at both ends thereof, respectively, said pivot levers being pivotally mounted on a cylinder body, and cam means for tipping and displacing the tensioning rails in common relatively to one another so that the printing plate is pivotable about a precisely defined pivot point, said pivot levers for adjusting the tensioning rails being constructed as angular levers and being pivotally mounted on bearing bolts at the bottom of a cylinder channel formed in the cylinder body, said angular levers, respectively, having two legs each differing in length, each of said angular levers having a pivot point offset towards the shorter of said two legs thereof and, in a midposition of said angular levers, means located thereon for mutually connecting the tensioning rails and said angular levers are disposed on imaginary lines extending perpendicularly to a longitudinal axis of the plate cylinder.

* * * * *